US006382549B1

(12) United States Patent
Krake

(10) Patent No.: US 6,382,549 B1
(45) Date of Patent: May 7, 2002

(54) HOLDER FOR STRINGS OF DECORATIVE LIGHTS

(76) Inventor: Christopher P. Krake, 22500 NE. 128th Cir., Brush Prairie, WA (US) 98606

( * ) Notice: Subject to any disclaimer, the term of this patent is extended or adjusted under 35 U.S.C. 154(b) by 0 days.

(21) Appl. No.: 09/619,809

(22) Filed: Jul. 21, 2000

(51) Int. Cl.[7] ..... B65H 75/06; B65H 75/40

(52) U.S. Cl. ..... 242/405.2

(58) Field of Search ..... 242/405.2, 405.1, 242/388, 388.1, 388.5, 400.1, 404.3, 603, 222; 191/12 R, 12.2 R; 24/71.1; 294/170, 158, 159; 206/419, 420

(56) References Cited

U.S. PATENT DOCUMENTS 4,123,012 A 10/1978 Hough
4,261,529 A 4/1981 Sandberg et al.
4,586,675 A 5/1986 Brown
4,778,125 A 10/1988 Hu
5,064,067 A * 11/1991 McAllister et al. ..... 206/420
5,181,757 A * 1/1993 Montoya ..... 294/170
5,458,241 A 10/1995 Brown ..... 206/419
5,507,544 A * 4/1996 McQuade et al. ..... 294/170
5,526,931 A * 6/1996 White ..... 206/420
5,667,266 A * 9/1997 Giocanti ..... 294/170
6,003,803 A * 12/1999 Knapp et al. ..... 242/388
6,135,381 A * 10/2000 Teson ..... 242/405.2
6,286,777 B1 * 9/2001 Black ..... 242/405.2

* cited by examiner

*Primary Examiner*—John M. Jillions
(74) *Attorney, Agent, or Firm*—James D. Givnan, Jr.

(57) ABSTRACT

A light string holder has a central hand grip with upright members spaced from the hand grip to partially define storage areas for light string segments. Lateral extensions on the hand grip have horizontal edges for supporting spaced apart loops of a light string. Removal of the light string loops is upwardly to permit segments of the light string to disentangle from one another. Slots in the holder receive ends of the light string.

3 Claims, 1 Drawing Sheet

HOLDER FOR STRINGS OF DECORATIVE LIGHTS

BACKGROUND OF THE INVENTION

The present invention concerns a device for receiving and storing decorative lights of the type commonly used during the Christmas season.

Strings of decorative lights present a problem in providing orderly storage of same without tangling of the string segments. The problem is particularly encountered with that type of light string termed an icicle string which characteristically include a main conductor having branch conductors several inches in length spaced at a foot or so apart along the main conductor. The practice of forming superimposed loops of such light strings for storage on a shelf or suspended from a horizontal post is unsatisfactory in that the branch conduits tend to become intertwined with other like string components to obstruct the orderly storage and subsequent use of the lights.

U.S. Pat. Nos. 5,458,241 4,778,125, 4,261,529 and 4,123,012 each discloses a holder for a cord or a decorative light string with an elongate opening providing a hand grip and with recessed areas at its ends to receive the light string or cord wound about the holder.

U.S. Pat. No. 4,586,675 discloses a cord holder having a pair of arms on which a cord is wrapped with the arms and end members defining cord receiving areas.

SUMMARY OF THE PRESENT INVENTION

The present invention concerns a holder for reception of a decorative light string enabling storage of same and, more importantly, the orderly removal of light string loops during installation of same on a building structure without encountering tangling of string components.

The holder includes a three dimensional planar body having string supporting, upwardly opening areas oppositely spaced from a central hand grip and having end members which define light string storage areas. The three dimensional holder is of a depth so as to separate light string loops depending from either side of the holder to space the loops and branch conductors thereon from one another and subsequently permitting upward removal from the holder permitting the loops and the branch conductors thereon to be lifted free from contact with adjacent conductors in a loop. Notches in the device permit retention of plug and socket ends of the light string or strings.

Important objectives of the present invention include a holder particularly suited for retention of decorative light strings, and particularly those referred to as icicle lights having branch conductors several inches in length spaced therealong and each having multiple lights thereon.

The holder is of a depth so as to promote separation of depending pair of loops each from opposite sides of the holder; the provision of a light string holder of suitable cross sectional depth to promote separation of the looped light strings; the provision of a light string holder which secures the ends of the light strings in place within string receiving grooves.

DETAILED DESCRIPTION OF THE PREFERRED EMBODIMENTS

Figure 1:
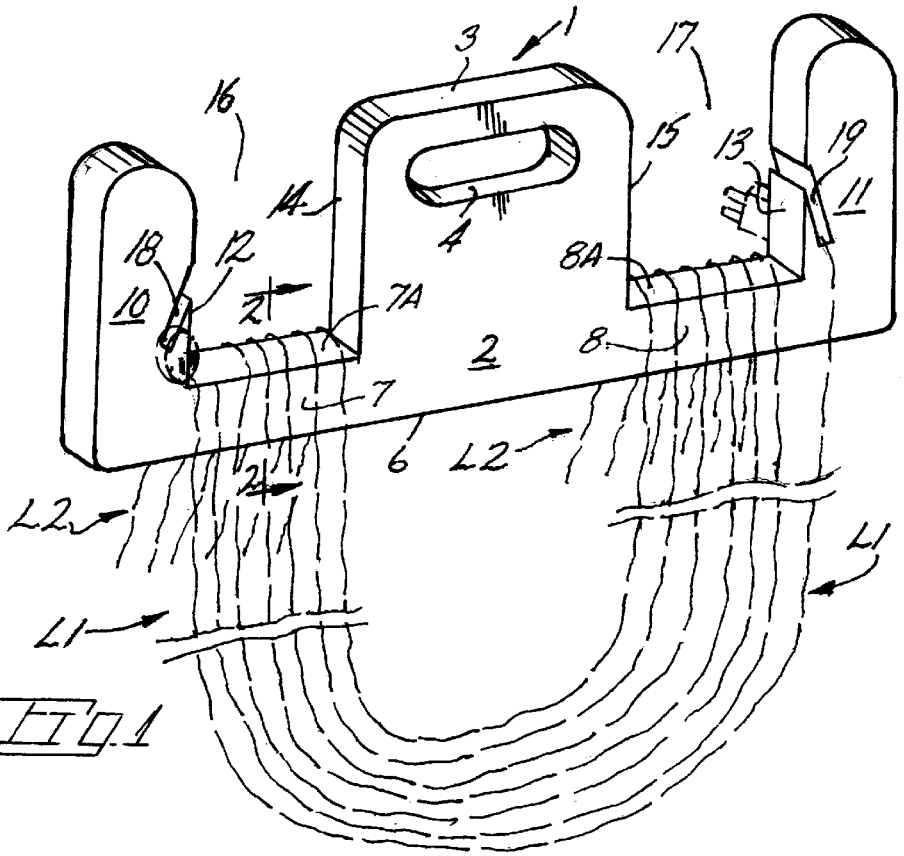
FIG. 1 is a perspective view of the present holder with light string loops L1–L2 shown in broken lines.

With continuing attention to the drawing wherein applied reference numerals indicate parts similarly hereinafter identified, the reference numeral 1 indicates generally a hand grip of the present light string storage device which is located centrally of an elongate body at 2. An opening 4 receives the user's fingers. A top or upper edge of the hand grip is indicated at 3. A lower edge of the holder is at 6.

Projecting outwardly in opposite directions from main body 2 are light string supporting edges at 7A and 8A on lateral extensions 7 and 8 and on which light string loops L1 and L2 are carried.

End members at 10 and 11 of the holder have inwardly facing edges at 12 and 13 which serve to confine the loops in place. Vertical edges at 14 and 15 on the hand grip 3, in conjunction with the above noted edges, define cord or light string receiving areas at 16 and 17 which are of adequate depth to receive several superimposed segments of a light string or strings.

If so desired, the upright end members may be provided with slots at 16 and 17 in which an end segment of a light string conductor may be inserted and retained.

To prevent tangling of the light string conductors and especially those termed icicle lights during removal from the holder the loops are lifted in succession upwardly from edges 7A–8A per arrow 20 whereupon the conductors will tend to disengage themselves lengthwise from adjacent conductors.

Figure 2:
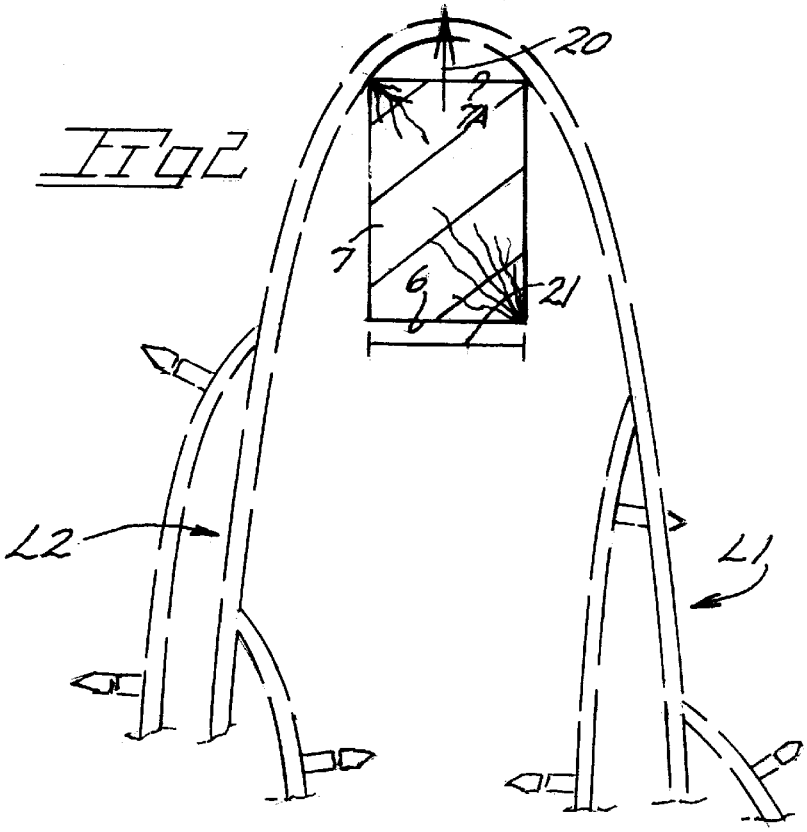
FIG. 2 is a vertical sectional view taken along line 2—2 of FIG. 1.

The depth of the holder is desirably approximately ¾ of an inch at 21 to space apart loops L1 and L2 one on each side of the holder as best shown in FIG. 2 for loop separation.

While the present device is described in conjunction with a decorative light string, it is to be understood that it may alternatively be utilized as a holder for electrical extension cords which may be carried thereon in spaced apart, depending loops from lateral extensions 7 and 8.

While I have shown but one embodiment of the invention, it will be apparent to those skilled in the art that the invention may be embodied still otherwise without departing from the spirit and scope of the claimed invention.

Having thus described the invention, what is desired to be secured by a Letters Patent is:

1. A storage device for decorative light strings comprising, an elongate planar body having a centrally disposed hand grip defining an elongate opening for insertion of the user's fingers and having oppositely disposed vertical edges each partially defining a light string storage area, upright members each having a vertical edge in parallel with and offset from one of said vertical edges and partially defining a light string storage area, at least one of said upright members defining a slot in communication with a light string storage area for reception of a light string end segment, and laterally projecting extensions on said hand grip and each integral with the hand grip and one of said upright members and having a horizontal edge uniform in length and partially defining a light string storage area and from which a light string may be supported in depending loops adjacent opposite sides of the storage device.

2. The storage device claimed in claim 1 additionally including a decorative light string having first and second series of loops, each of said loops supported on the horizontal edge of said laterally projecting extensions to facilitate separation of the series of loops.

3. The storage device claimed in claim 2 wherein said elongate planar body is of greater depth than one half inch for separation of the light string loops.

* * * * *